US006321498B1

(12) United States Patent
Trovato

(10) Patent No.: US 6,321,498 B1
(45) Date of Patent: Nov. 27, 2001

(54) FORMWORK FOR BUILDING WALLS

(76) Inventor: Salvatore Trovato, Via Provinciale per S.M. Ammalati No. 187/A, 95020 S.M. Ammalati-Acireale (Catania) (IT)

( * ) Notice: Subject to any disclaimer, the term of this patent is extended or adjusted under 35 U.S.C. 154(b) by 0 days.

(21) Appl. No.: 09/486,004

(22) PCT Filed: Aug. 22, 1998

(86) PCT No.: PCT/EP98/05493

§ 371 Date: Feb. 18, 2000

§ 102(e) Date: Feb. 18, 2000

(87) PCT Pub. No.: WO99/11883

PCT Pub. Date: Mar. 11, 1999

(30) Foreign Application Priority Data

Sep. 2, 1997 (IT) ..... CT97A0026

(51) Int. Cl.[7] ..... E04B 2/10

(52) U.S. Cl. ..... 52/426; 52/302.1; 52/425; 52/427; 52/415; 52/431; 52/424

(58) Field of Search ..... 52/302.1, 415, 52/424, 427, 431, 425, 426

(56) References Cited

U.S. PATENT DOCUMENTS 5,632,126 * 5/1997 Agsten ..... 52/426
6,148,576 * 11/2000 Janopaul, Jr. ..... 52/426

FOREIGN PATENT DOCUMENTS 1814456 6/1970 (DE) .
19501112 11/1995 (DE) .
0692585 1/1996 (EP) .
483097 5/1917 (FR) .

* cited by examiner

*Primary Examiner*—Carl D. Friedman
*Assistant Examiner*—Christy M. Syres
(74) *Attorney, Agent, or Firm*—Merchant & Gould P.C.

(57) ABSTRACT

A formwork for building bearing walls comprises a plurality of pairs of facing panels (PE, PI) connected together so as to form an inside space between them, said pairs of facing panels being arranged in superimposed rows, the panels of each pair being connected to each others by braces (6) of adjustable length with both the braces (6) and the panels (PE, PI) being left in the wall formed when a cementitious material poured in said inside space has solidified. The so formed walls are provided with bearing partition members and ventilating duct, and are strongly insulated and already finished (FIG. 6).

13 Claims, 2 Drawing Sheets

FORMWORK FOR BUILDING WALLS

FIELD OF THE INVENTION

The present invention relates to building construction and more particularly to the construction of building walls, both inside and outside ones.

The invention is concerned with formworks for building walls, as well as with multi-layer panels for realizing such formworks, and with a method for building walls.

The invention is preferably applicable, but not limited to, (load) bearing walls, by using disposable formworks elements, formed as multi-layer panels that are dry-assembled.

BACKGROUND ART

The known methods of constructing walls in building and civil engineering works require a large amount of labour, particularly in the finishing stage. On the other hand prefab constructions have rigid design and require an assembling apparatus that is not always available in medium and small building yards.

OBJECT OF THE INVENTION

It is an object of the present invention to provide improved formwork elements and a method of constructing building walls by using such formwork elements that involves a labour saving by reducing as much as possible the carpentry costs and the wall-finishing costs, while at the same time allowing the design and constructive flexibility deriving by the use of bricks.

These objects are accomplished through a formwork, a multi-layer panel and a method for building a wall as claimed in claims 1, 8 and 9, respectively. Further advantageous features of the invention are recited in the dependent claims.

DISCLOSURE OF THE INVENTION

According to a first aspect the invention consists of a formwork for building walls by using basic multi-layer elements to be manufactured at a factory that are finally incorporated in the concrete pouring, such elements forming the inside and outside facings and being firmly secured to the building skeleton with the associated safety advantages in respect of seismic events.

Such formwork is formed by a plurality of pairs of facing panels connected together so as to form an internal space between them, with pairs of facing panels arranged in superimposed rows, and the panels of each pair being connected to each others by braces of adjustable length. Both the braces and the panels are left in the wall formed after a cementitious material poured in said inside space has set.

According to a second aspect, the invention consists in a multi-layer panel for building walls comprising two or more layers of material, one of which is adapted to form the facing of the finished wall, and the other is formed by a slab or sheet of a rigid insulating material, with a plurality of interposed spacing members or ribs connecting the two layers so as to define channels therebetween.

According to a third aspect, the invention consists of a method for building walls by using such formwork elements.

BRIEF DESCRIPTION OF THE DRAWINGS

The invention will now be disclosed with reference to some preferred but non-limiting embodiments thereof, illustrated in the attached drawings in which.

DETAILED DESCRIPTION OF PREFERRED EMBODIMENTS

Figure 1:
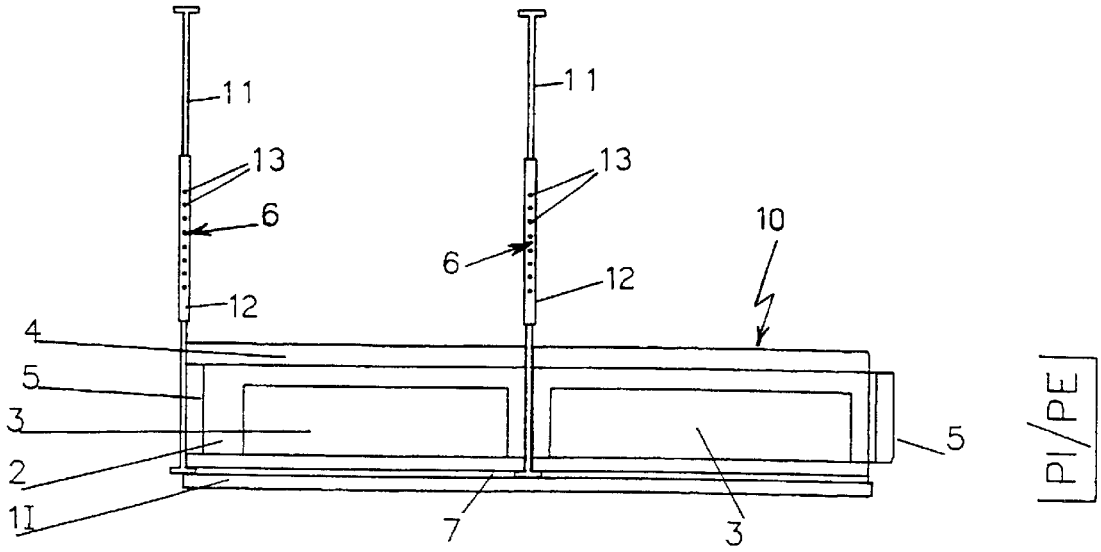
FIG. 1 is a top view of a basic panel illustrating the structure thereof with a pair of braces fitted to the panel.
Figure 2:
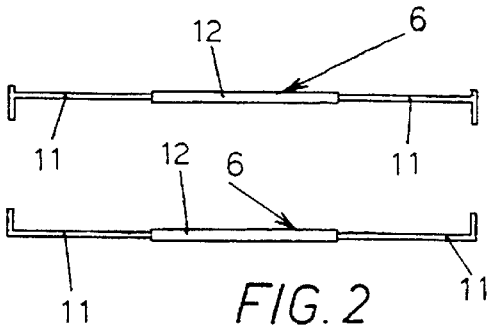
FIG. 2 show two braces for clamping together a pair of facing panels according to the invention.
Figure 3:
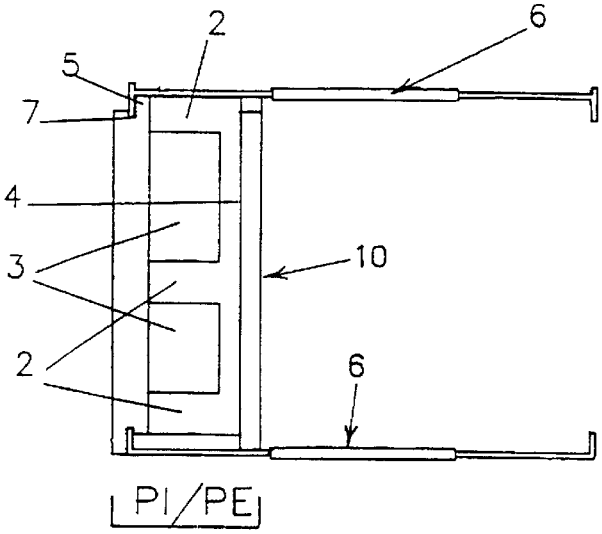
FIG. 3 is side view of the panel-braces arrangement of FIG. 1.

Referring now to the Figures, and in particular to FIGS. 1 to 3, the formwork according to the invention is formed by basic multi-layer panels 10. A pair of panels 10 disposed in front of each other at a predetermined distance and secured by brace means form a modular formwork elements.

The panels 10 are of two types, i.e. outside panels PE or inside panels PI. More precisely a panel PE is used when building an external wall of the building, with the other panel of the pair being a PI panel. When building an inside wall such as a partition, the panels of each pair are both PI panels, not necessarily with the same structure.

The multi-layer panel (PE or PI) has preferably a rectangular shape and comprises a finishing or facing layer 1E or 1I, adapted to form the inside or outside facing of the finished wall, respectively, a layer of an insulating rigid material 4 and a plurality of interposed spacing members 2 or ribs connecting to each other the layers 1E or 1I and 4. The ribs 2 are parallel to each other and parallel to either one or the other of the rectangle sides so as to define channels 3.

When a plurality of panels PE or PI are assembled in a plane to form a wall, the aligned channels 3 form passages that can be used for ventilating purposes or for receiving electrical cables and/or water pipes and the like.

The facing layer 1E forming the outside facing of the wall can be a stone slab, a tile, a layer formed by mixture of cement and granules of stones, marbles, ceramics, etc., as well as synthetic plastic materials.

The facing layer 1I forming the inside facing of the wall can be made of plaster, putty, plastered board (cartongesso, plastered tiles, etc.

The insulating layer 4 is formed by rigid plates or sheets of either synthetic materials such as polyurethane, polystyrene, or natural materials such as cork, glass wool, glass wool, or a composite material; such as cellular cement and mixtures of cements and granules of polystyrene, or expanded clay, or vermiculite, etc.

The basic panels 10 will be manufactured in factories in accordance with conventional techniques, for example by mixtures of cement, tiles or ceramics, shaped in suitable moulds, presses or vibrating apparatus, etc.

The basic panel is provided along its whole periphery with daps 5 on both the facing layer and the insulating layer. These daps are male daps on the two adjacent sides and females on the remaining two. Preferably the daps are formed by properly positioning the ribs 2.

Figure 4:
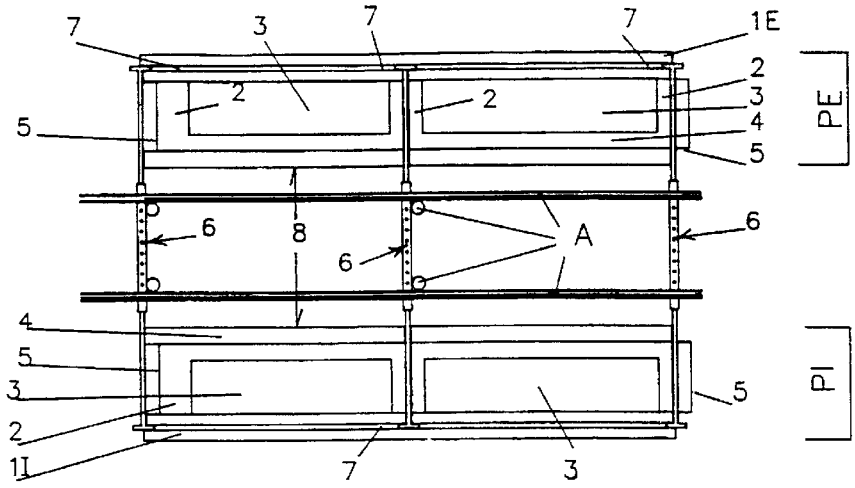
FIG. 4 is a top view illustrating a pair of facing basic panels connected by braces to build up modular formwork elements.
Figure 5:
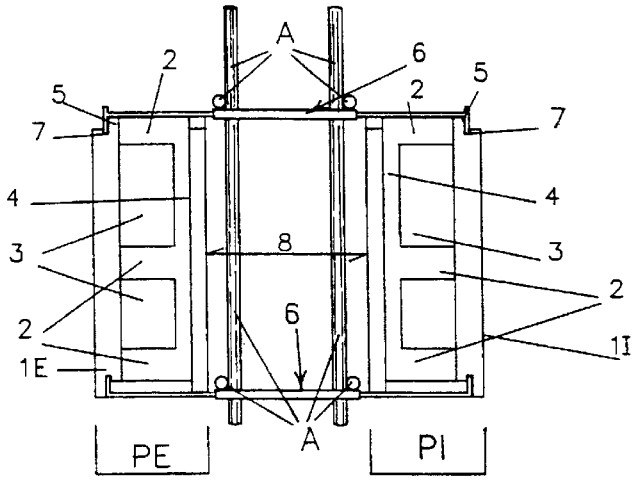
FIG. 5 is a side view of the arrangement shown in FIG. 4.

Holes 7 are formed in the thickness of the panel along the sides that will be horizontally positioned, preferably the longer sides, for receiving the ends of braces or brackets 6 adapted to join together in facing relationships two basic panels in order to form a modular formwork element, as shown in FIGS. 4 and 5. Braces 6 have preferably a shape resembling a (flat) H, so that they can clamp to each other pairs superimposed of basic panels 10. When no other panel is to be assembled onto a pair, a C-shape brace will be used. According to a non limiting embodiment shown in the Figures, a brace 6 comprises two rods slidably received in a sleeve provided with a plurality of holes, the ends of the rods projecting from said sleeve being provided with means to engage the holes 7 in the thickness of the facing layers 1E, 1I. In accordance with another embodiment (not shown in the drawings), the brace 6 comprises a tubular member provided with an inner thread and two threaded bars the position of which is continuously adjustable with respect to such tubular member.

Braces 6 accomplish two tasks:

1. positioning and connecting to each other two facing basic panels that will form a modular formwork element of the framework in which a cementitious material, such as concrete, will be poured;
2. anchoring the two panels to the bearing structure since they will be embedded in the solidified cementitious material.

Additional particular members can be added for forming corners, door and window lintels, etc. all of which will include the insulating material layer so as to prevent forming of heat bridges (paths).

Figure 6:
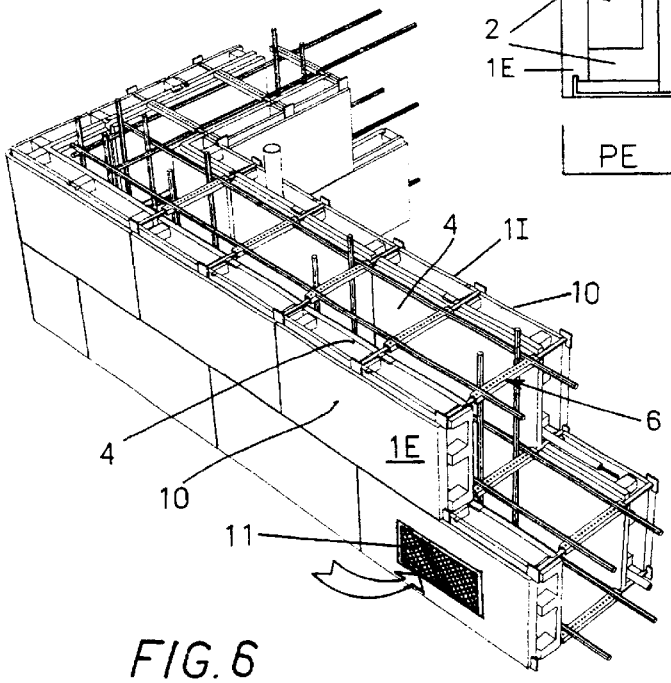
FIG. 6 is a perspective view showing the construction of two cornering walls.

By forming rows of the pairs of panels facing to each other and connected by a proper number of braces (that is of modular formwork elements) and superimposing the rows to each other, as shown in FIG. 6, a complete formworks is obtained. By preferably pouring concrete or a suitable cementitious material in the space comprised between the insulating slabs 4 of each pair of panels a wall in obtained that is already provided with either the inside or the outside facings or both, as required, and is thermally insulated and provided with ventilating ducts.

As shown in FIGS. 4 to 6, reinforcing steel rods A can be secured to the braces 6, particularly when using concrete. The braces 6 are embedded into the poured material and replace the transverse rods with the longitudinal and vertical rods A that are tied or otherwise secured to them.

The thickness 8 of the wall is easily selected by adjusting the length of the braces 6.

Thanks to the invention, it is possible to build bearing walls of concrete, in case reinforced concrete of a given thickness that are insulated and already provided with the inside and/or outside facings, as well as with ventilating ducts.

Industrial Applicability

The invention is applicable in the construction of building walls, both inside and outside ones.

What is claimed is:

1. A formwork for builiding walls comprising:

a first facing panel comprising a first facing layer and a first insulating layer, with a first plurality of parallel spacing members disposed therebetween, the first plurality of parallel spacing members cooperating with the first facing layer and the first insulating layer to form horizontal and vertical channels in communication with each other between the first facing layer and the first insulating layer;

a second facing panel comprising a second facing layer and a second insulating layer, with a second plurality of parallel spacing members disposed therebetween, the second plurality of parallel spacing members cooperating with the second facing layer and the second insulating layer to form horizontal and vertical channels in communication with each other between the second facing layer and the second insulating layer; and braces of adjustable length that are configured to extend from the first facing panel to the second facing panel;

wherein the first facing panel and the second facing panel cooperate to form a space therebetween, and the braces and the first and second facing panels are left in place when a cementitious material poured in the inside space has solidified.

2. The formwork of claim 1, wherein each of the first insulating layer and the second insulating layer comprise a slab of rigid insulating material.

3. The formwork of claim 1, wherein each of the braces comprise two rods slidably received in a sleeve provided with a plurality of holes, with ends of the rods projecting from the sleeve comprising means to engage the first and second facing layers.

4. The formwork of claim 1, wherein the first facing layer comprises one of an outside facing or an inside facing.

5. The formwork of claim 1, wherein the second facing layer comprises one of an outside facing or an inside facing.

6. The formwork of claim 1, further comprising reinforcing rods that are positioned within the inside space and that are secured to the braces.

7. The formwork of claim 1, wherein each of the first facing panel and the second facing panel have a rectangular shape.

8. The formwork of claim 7, wherein each of the first facing panel and the second facing panel further comprise daps positioned along an entire periphery of each facing panel, the daps provided on both the first and second facing layers and the first and second insulating layers.

9. The formwork of clam 8, wherein the daps along two adjacent sides of each facing panel comprise male daps and the daps along two other sides of each facing panel comprise female daps.

10. A wall that is built using and incorporating the formwork of claim 1.

11. A multi-layer panel for building walls, the multi-layer panel comprising a facing layer and a insulating layer, with a plurality of parallel spacing members disposed therebetween, the plurality of parallel spacing members cooperating with the facing layer and the insulating layer to form horizontal and vertical channels in communication with each other between the facing layer and the insulating layer.

12. A method for building walls provided with ventilating ducts, comprising steps of:

providing a plurality of pairs of facing panels, each pair of facing panels comprising:

a first facing panel comprising a first facing layer and a first insulating layer, with a first plurality of parallel spacing members disposed therebetween, the first plurality of parallel spacing members cooperating with the first facing layer and the first insulating layer to form horizontal and vertical channels in communication with each other between the first facing layer and the first insulating layer; and a second facing panel comprising a second facing layer and a second insulating layer, with a second plurality of parallel spacing members disposed therebetween, the second plurality of parallel spacing members cooperating with the second facing layer and the second insulating layer to form horizontal and vertical channels in communication with each other between the second facing layer and the second insulating layer;

assembling together the pairs of facing panels with bracing means so as to form an inside space between said facing panels;

arranging the pairs of facing panels in superimposed rows; and pouring a cementitious material in the inside space whereby both facing panels and bracing means are embedded in the wall when said cementitious material solidifies.

13. The method of claim 12, wherein the wall is a bearing wall.

* * * * *